United States Patent [19]

Halvorsen

[11] 4,248,697

[45] Feb. 3, 1981

[54] OIL AGGLOMERATION PROCESS

[75] Inventor: William J. Halvorsen, Pittsburgh, Pa.

[73] Assignee: Consolidation Coal Company, Pittsburgh, Pa.

[21] Appl. No.: 42,748

[22] Filed: May 29, 1979

[51] Int. Cl.[3] ..... B03B 1/04

[52] U.S. Cl. ..... 209/5; 209/49; 44/24

[58] Field of Search ..... 209/5, 49, 211; 44/24

[56] References Cited

U.S. PATENT DOCUMENTS

| | | | |
|---|---|---|---|
| 1,420,164 | 6/1922 | Trent | 209/49 |
| 3,230,282 | 1/1966 | Lookeren | 209/5 X |
| 3,651,179 | 3/1972 | Shea | 44/24 X |
| 4,021,206 | 5/1977 | Huberts | 44/24 X |
| 4,089,776 | 5/1978 | McMurray | 209/49 |
| 4,133,647 | 1/1979 | Burke | 44/24 |
| 4,164,467 | 8/1979 | Liller | 209/211 |

FOREIGN PATENT DOCUMENTS

| | | | |
|---|---|---|---|
| 988460 | 8/1976 | Canada | 209/5 |

*Primary Examiner*—Robert Halper

*Attorney, Agent, or Firm*—F. Lindsey Scott; William A. Mikesell, Jr.

[57] ABSTRACT

In methods for producing agglomerate particles from aqueous slurries containing from about 10 to about 40 weight percent solids, the solids comprising finely divided carbonaceous solids and finely divided inorganic solids, by mixing the aqueous slurry with oil in a first mixing zone to form a mixture and thereafter further agitating the resulting mixture in at least one other mixing zone to produce agglomerate particles containing the carbonaceous solids and the oil and recovering the product agglomerate particles, an improvement comprising (a) separating finely divided inorganic solids from the aqueous slurry after removal of the product agglomerate particles therefrom; (b) thereafter separating smaller agglomerates of carbonaceous solids and oil from the aqueous slurry after separation of the product agglomerate particles and the inorganic solids therefrom; and (c) recycling the smaller agglomerates to the second mixing zone.

5 Claims, 1 Drawing Figure

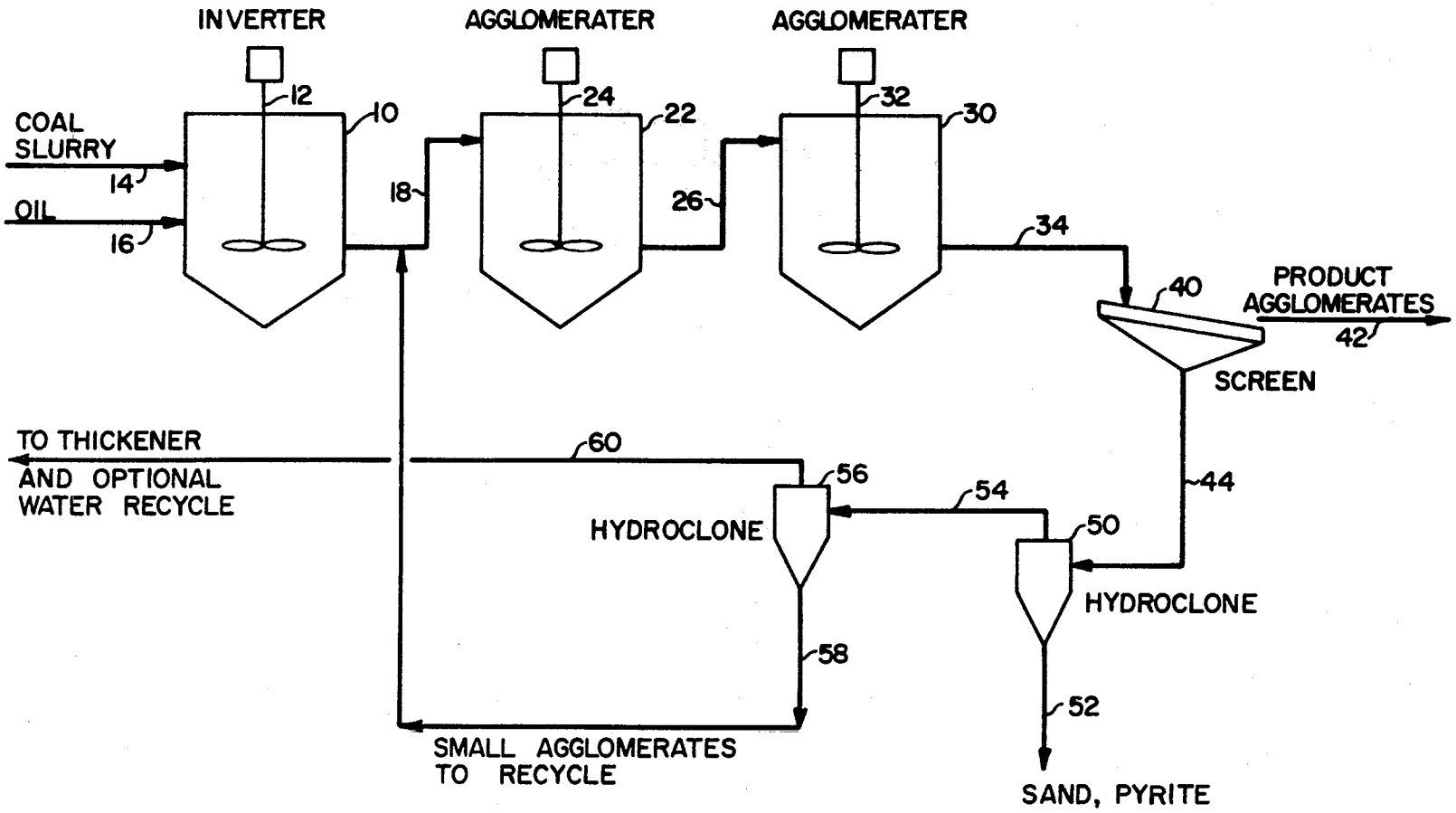
INVERTER
12
10
COAL SLURRY
14
OIL
16
18
AGGLOMERATER
24
22
26
AGGLOMERATER
32
30
34
40
SCREEN
PRODUCT AGGLOMERATES
42
44
HYDROCLONE
50
52
SAND, PYRITE
54
56
HYDROCLONE
58
SMALL AGGLOMERATES TO RECYCLE
60
TO THICKENER AND OPTIONAL WATER RECYCLE

OIL AGGLOMERATION PROCESS

This invention relates to the recovery of finely divided carbonaceous solids from aqueous slurries.

This invention further relates to the selective recovery of finely divided carbonaceous solids from aqueous slurries containing finely divided carbonaceous solids in mixture with finely divided inorganic solids.

This invention further relates to the recovery of finely divided carbonaceous solids from aqueous slurries containing finely divided carbonaceous solids and finely divided inorganic solids by mixing the aqueous slurry with oil thereby agglomerating the carbonaceous solids and oil into agglomerate particles which are readily recovered for use as particulate fuel and the like.

In coal mining processes, a cleaning step is normally used to remove inorganic materials and the like from the coal product. As a result of such cleaning steps, a by-product stream is usually produced which contains finely divided carbonaceous solids and finely divided inorganic solids. Such streams in the past have been passed to blackwater ponds for storage and allowed to accumulate. Water is, in some instances, withdrawn from the blackwater pond and recycled to the process, and in other instances the water is merely allowed to evaporate from such ponds. Clearly, the presence of such ponds containing the carbonaceous solids present a continuing threat of overflow and the like with the resulting unsightly pollution of the downstream areas. Further, the carbonaceous solids contained in such ponds represent the loss of a valuable fuel product. Accordingly, increasing efforts have been directed to methods whereby such finely divided carbonaceous solids can be recovered, both from such waste streams and from blackwater ponds in a form suitable for use as fuels, coke oven feedstocks and other applications known to those in the art for coal.

One such process comprises the mixing of aqueous slurries containing finely divided carbonaceous solids and finely divided inorganic solids with oil to thereby selectively agglomerate the carbonaceous solids and oil to produce particulate fuels. In such processes, varying amounts of carbonaceous material are produced as very small agglomerates, i.e. less than 28 Tyler mesh and is eventually lost at a screening operation or the like where the larger product agglomerates are separated and passed to use as a fuel or the like. The amount of carbonaceous material lost at the screening operation is of course dependent upon the effectiveness of the agglomeration process, the nature of the aqueous slurry passed to the process and the like. In any event, it is highly desirable that such small agglomerates which have been through the process already, be recovered since they constitute a potentially valuable fuel.

It has now been found that such small carbonaceous agglomerates which have already been through the process and, as a result, treated with oil, are readily recovered by subjecting the underflow stream from the screening operation to cycloning. A first cyclone is used to separate sand, pyrites, clays and the like from the aqueous underflow stream with the overflow from the cyclone being passed to a second cyclone which is adapted to recover such small carbonaceous agglomerates for recycle to the agglomeration process.

FIG. 1 is a schematic diagram of a process utilizing the improvement of the present invention.

In FIG. 1, an inverter 10 including a stirrer 12 is shown. A coal slurry is charged to inverter 10 through a line 14 with oil being charged to inverter 10 through a line 16. It is understood that while the addition of the coal slurry is shown through a single line, that the coal and water could be added separately if desired for any reason. In inverter 10, the mixture is vigorously stirred and inversion occurs. The term 'inversion' is used to refer to the phenomenon wherein the carbonaceous solids become coated with oil and begin to agglomerate and separate from the aqueous medium. After inversion, the mixture is passed through a line 18 to a first agglomerator vessel 22 which includes a stirrer 24 where the mixture is agitated further to result in the production of larger agglomerates which are then passed as an aqueous slurry through a line 26 to a second agglomerator 30 including a stirrer 32 where the mixture is further agitated although optionally at a lower rate to produce still larger agglomerates which are then passed as a slurry through a line 34 to a screen 40 where the product agglomerates are recovered and passed to product via a suitable conveyor 42 with the underflow from the screen being passed to further processing through a line 44. The screen may be of any suitable size, although it is preferred that a 28 Tyler mesh be used. As a result, the product agglomerates will be larger than 28 Tyler mesh with those solids which are smaller than 28 Tyler mesh being found in the underflow from the screen. The underflow from the screen flowing through line 44 is passed to a first cyclone, shown as a hydroclone 50, which is designed to separate sand, pyrites, clays and other inorganic solids from the underflow stream. The underflow from first cyclone 50 is discharged via a line 52 to waste or the like and the overflow from first cyclone 50 is passed through a line 54 to second cyclone, shown as a hydroclone, 56 wherein the small carbonaceous agglomerates are separated and passed through a line 58 back to join the aqueous slurry flowing through line 18 to agglomerator 22. The overflow from second hydroclone 56 is passed through a line 60 to a thickener and optional water recycle or the like.

As is known to those skilled in the art, the coal slurry passed to inverter 10 desirably contains from about 10 to about 40 weight percent solids and oil is normally added to vessel 10 in an amount equal to from about 10 to about 20 weight percent based on the amount of carbonaceous solids contained in the aqueous slurry charged to inverter 10. The agglomerates produced from screen 40 typically contain from about 10 to about 15 weight percent oil. The agitation in inverter 10 is at a relatively high mixing rate, with mixing rates from about 0.1 to about 1.25 hp/ft.$^3$ being suitable. Values from 0.15 to about 0.5 hp/ft.$^3$ are more typical. The agitation rates in first agglomerator 22 and second agglomerator 30 are normally somewhat lower than values from about 0.1 to about 0.4 hp/ft.$^3$ being typical. Typically, the agitation rate in second agglomerator 30 is somewhat lower than in first agglomerator 22. First hydroclone 50 is designed to selectively separate sand, pyrites, clays and other heavy finely divided inorganic materials without removing the small carbonaceous agglomerates from the aqueous stream. Similarly, second hydroclone 56 is designed to selectively remove the small carbonaceous agglomerates from the clay-containing water.

The design of cyclones to accomplish such objectives is known to those skilled in the art and would be determined by the internal design of the cyclone, the fluid velocity in the cyclone, the differential pressures used across the cyclone, and the like. Such design parameters are well known to those skilled in the art and need not be discussed further. Cyclones are widely used in the cleaning of fine coals, etc. and are of a variety of types such as hydroclones, triclones and the like as known to the art.

Desirably, the stream containing the small carbonaceous agglomerates is recycled to first agglomerator 22 since this stream has already been subjected to the inversion step occurring in vessel 10. The loss of such small agglomerates is particularly undesirable since they have already been treated with oil and are suitable for agglomeration. Upon recycle to first agglomerator 22, these small agglomerates are placed back into the process at a point where their further agglomeration is readily accomplished. It is pointed out that the steps of the improvement must be accomplished in the sequence shown since it is highly undesirable that the finely divided inorganic solids, sands, pyrites and the like be recycled to the process. It is particularly undesirable that these materials be returned to the process after the inversion step. Accordingly, it is clear that the first separation step is necessary in order to achieve the desired objectives of the present improvement. The use of the present improvement is particularly effective in eliminating the loss of desirable materials during start-up operations, during process upsets wherein the composition of the incoming coal slurry may be rapidly varied, and the like. It is undesirable that substantial quantities such small agglomerates be permitted to pass to the thickener and to waste if such can be prevented. The improvement of the present invention presents a method whereby the loss of such materials is eliminated by recycling such materials back to the process prior to passing the aqueous stream from the screen to thickening, recycle or the like. While the aqueous stream may have formerly been passed to recycle, normally most, if not all, of the solid materials and any excess oil would have been removed in the thickener.

Having thus described the present invention by reference to certain of its preferred embodiments, it is pointed out that many variations and modifications are possible within the scope of the present invention and it is believed that many such variations and modifications may appear obvious and desirable to those skilled in the art upon a review of the foregoing description of preferred embodiments.

Having thus described the invention, I claim:

1. In a method for producing agglomerate particles from an aqueous feed slurry containing from about 10 to about 40 weight percent solids, said solids comprising finely divided carbonaceous solids and finely divided inorganic solids said inorganic solids comprising sand, pyrites and clays by mixing said aqueous slurry containing said solids and oil in a first mixing zone to form a mixture and thereafter further mixing said mixture in at least one other mixing zone thereby forming product agglomerate particles containing said carbonaceous solids and said oil and recovering said product agglomerate particles, the improvement comprising;

(a) separating finely divided inorganic solids consisting of sand, pyrites and clays from said aqueous slurry after separating said product agglomerate particles therefrom;

(b) thereafter separating smaller agglomerates of said carbonaceous solids and oil below the size selected as the minimum in said agglomerate recovery step from said clay containing aqueous slurry after separation of said product agglomerate particles and said inorganic solids therefrom; and (c) recycling said smaller agglomerates to said other mixing zone.

2. The improvement of claim 1 wherein said smaller agglomerates are smaller than 28 Tyler mesh.

3. The improvement of claim 1 wherein said agglomerates contain from about 10 to about 15 weight percent oil.

4. The improvement of claim 1 wherein said inorganic solids are separated in a cyclone.

5. The improvement of claim 1 wherein said smaller agglomerates are separated in a cyclone.

* * * * *